United States Patent [19]

Loth et al.

[11] Patent Number: 4,589,207

[45] Date of Patent: May 20, 1986

[54] WALLPAPER TRIMMER

[76] Inventors: Andrew Loth; George Spector, both of 233 Broadway Rm 3615, New York, N.Y. 10007

[21] Appl. No.: 633,868

[22] Filed: Jul. 23, 1984

[51] Int. Cl.[4] ..... B26B 29/00

[52] U.S. Cl. ..... 30/287; 30/294; 30/305; 83/455

[58] Field of Search ..... 30/286, 287, 293, 294, 30/290, 296 R, 304, 305; 7/103, 105, 163; 33/32 R, 32 B, 32 C, 334; 83/454, 455

[56] References Cited

U.S. PATENT DOCUMENTS 1,996,224 4/1935 Wedekind ..... 30/293

3,394,457 7/1968 Holder ..... 30/294

*Primary Examiner*—Douglas D. Watts

[57] ABSTRACT

A wallpaper trimmer is provided and consists of an elongated straight edge, a body member having a downwardly extending lug that engages a groove in the straight edge so that the body member can slide along top surface of the straight edge and a perpendicular razor blade carried by the body member so that the razor blade can slide along an edge of the straight edge to cut wallpaper.

3 Claims, 4 Drawing Figures

WALLPAPER TRIMMER

BACKGROUND OF THE INVENTION

The instant invention relates generally to cutting devices and more specifically it relates to a wallpaper trimmer.

Numerous cutting devices have been provided in prior art that are adapted to cut straight through materials. For example U.S. Pat. Nos. 3,835,536; 4,041,605 and 4,295,273 all are illustrative of such prior art. While these units may be suitable for the particular purpose to which they address, they would not be suitable for the purposes of the present invention as heretofore described.

SUMMARY OF THE INVENTION

A principle object of the present invention is to provide a wallpaper trimmer adapted to ride laterally within a groove of a straight edge guide to produce straight line cuts.

Another object is to provide a wallpaper trimmer that utilizes any standard razor blade that is adjustable within the trimmer so that it can be used to cut various materials such as plywood, cardboard, newspaper or the like.

An additional object is to provide a wallpaper trimmer that can engage a detachable holder to double the cutting length by using two razor blades at the same time.

A further object is to provide a wallpaper trimmer that is simple and easy to use.

A still further object is to provide a wallpaper trimmer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
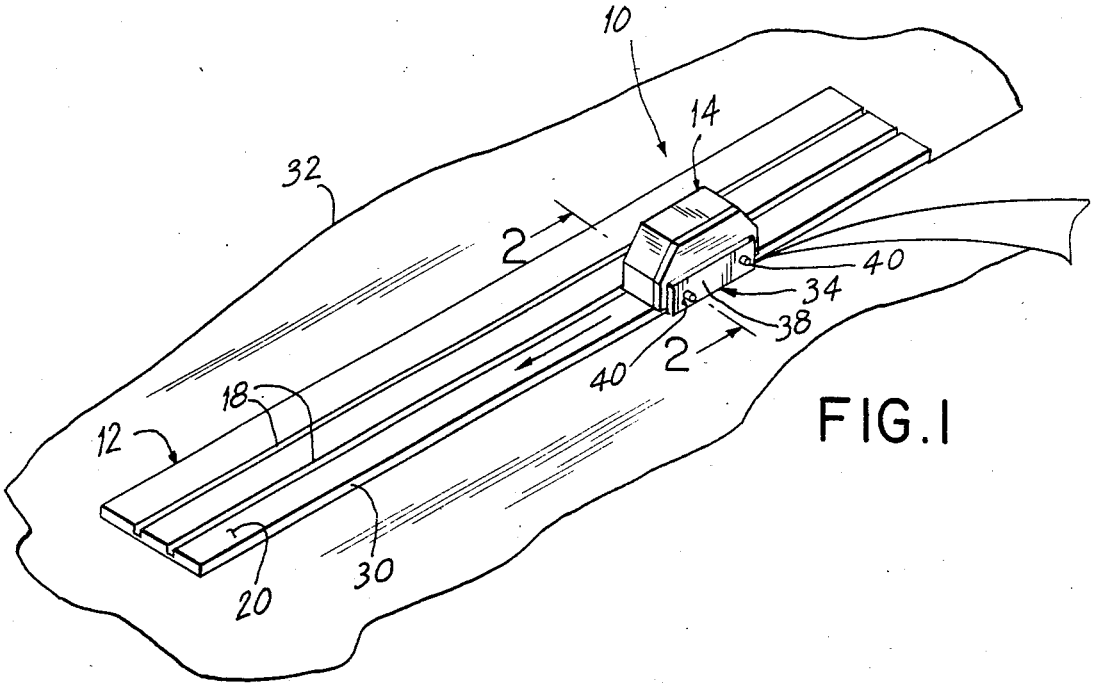
FIG. 1 is a perspective view of the invention in use.
Figure 2:
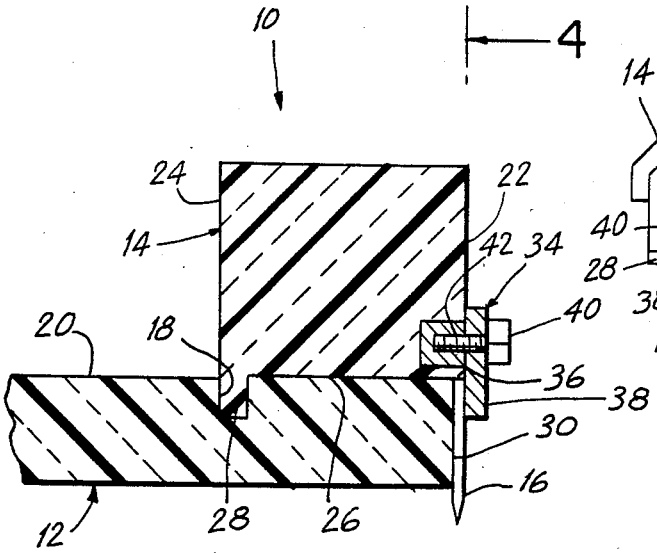
FIG. 2 is an enlarged cross sectional view taken along line 2—2 in FIG. 1.

Turning now descriptively to the drawings, in which similar reference characters denote similar elements throughout the several views, FIGS. 1 and 2 illustrates a wallpaper trimmer 10 that consists of an elongated straight edge 12, a body member 14 and a razor blade 16.

The elongated straight edge 12 has longitudinal grooves 18 within top surface 20. The body member 14 has a front face 22, a rear face 24, a flat bottom face 26 and a lug 28 extending downwardly from the flat bottom face 26 at the rear face 24. The lug 28 engages the groove 18 of the straight edge 12 so that the flat bottom face 26 of the body member 14 can slide along the top surface 20 of the straight edge 12.

The razor blade 16 is carried by the front face 22 of the body member 14 perpendicular to the flat bottom face 26. The razor blade 16 can slide along an edge 30 of the straight edge 12 to cut wallpaper 32.

The device 34 is provided for holding the razor blade 16 against the front face 22 of the body member 14. The device 34 consists of a pair of grommets 36, a plate 38 and a pair of bolts 40.

The grommets 36 are threaded and placed spaced apart within the front face 22 of the body member 14. The plate 38 has a pair of spaced apart apertures 42 therethrough. Each bolt 40 is placed through each aperture 42 in the plate 38 to threadably engage each threaded grommet 36 to hold the razor blade 16 against the front face 22 of the body member 14.

Figure 4:
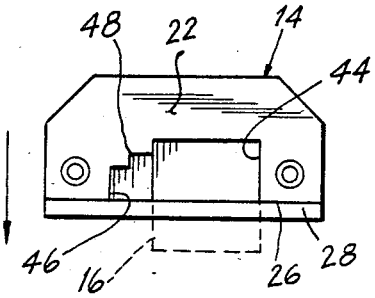
FIG. 4 is a cross sectional view taken along line 4—4 in FIG. 2 of a second modification showing an adjustable razor blade compartment to increase the depth of cut for various materials.

FIG. 4 shows the front face 22 of the body member 14 further having a recess 44 to engage the razor blade 16. When the plate 38 is secured to the front face 22 the recess 44 will hold the razor blade 16 in a proper position for cutting the wallpaper 32. The recess 44 in the front face of the body member contains an enlarged portion 46 that has a plurality of notches 48 in upper corner. Top edge of the razor blade 16 can be adjustably positioned within one of the notches 48 in the recess 44 to change depth of cut of the razor blade.

Figure 3:
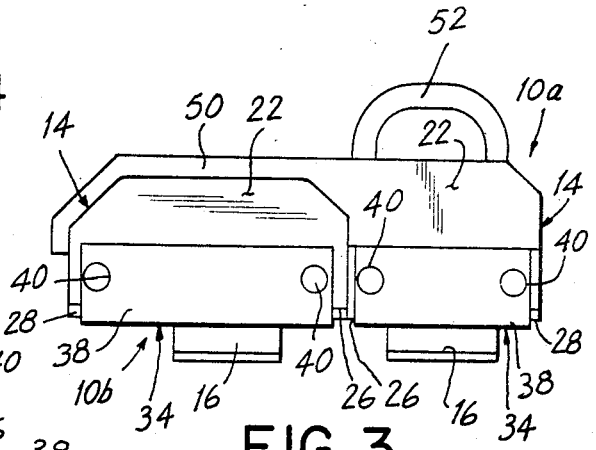
FIG. 3 is a side view of a first modification showing a detachable holder having a handle so as to double the cutting length utilizing two blades.

FIG. 3 shows a wall trimmer **10*a* further containing a hooked arm 50 and a handle 52. The hooked arm 50 extends outwardly from one side of the body member 14 to engage a second wall trimmer 10*b* so that the wall trimmers 10*a* and 10*b*** are aligned side by side.

The handle 52 extends from top of the body member 14 so that the wallpaper trimmer **10*a* can be gripped easily to slide both wallpaper trimmers 10*a* and 10*b* along the top surface 20 of the straight edge 12** to double cutting length.

The straight edge 12 and body member 14 including the arm 50 and handle 52 are made from lucite plastic material. The razor blade 16, grommets 36, plate 38 and bolts 40 are made from metal material.

The invention can be used on plywood, cardboard, newspaper, etc. The softer materials do not dull the blades. Approximately 500 cuts can be made with one blade. Any type of razor blade can be used. The wallpaper trimmer can be produced and packaged with paste brush and other items to be sold to homeowners and paperhangers.

To use the wallpaper trimmer 10 the top of the wallpaper 32 is measured to be cut and the razor blade 16 is set in place to hold the straight edge 12 from moving. Then the bottom of the wallpaper 32 is measured. With the left hand the straight edge 16 is held from moving and with the right hand the body member 14 is pulled toward you to cut the wallpaper 32.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A wall paper trimmer which comprises:

(a) an elongated straight edge having at least one longitudinal groove within the top surface;

(b) a body member having a front face, a rear face, a flat bottom face and a lug extending downwardly from said flat bottom face at said rear face, said lug engages said groove of said straight edge so that said flat bottom face of said body member can slide along said top surface of said straight edge; and (c) a razor blade carried by said front face of said body member perpendicular to said flat bottom face so that said razor blade can slide along an edge of said straight edge to cut wall paper, further comprising means for holding said razor blade against said front face of said body member, wherein said means for holding said razor blade against said front face of said body member comprises:

(a) a pair of spaced apart threaded grommets placed within said front face of said body member;

(b) a plate having a pair of spaced apart apertures therethrough; and (c) a pair of bolts, each said bolt placed through each said aperture in said plate to threadably engage each said threaded grommet to hold said razor blade against said front face of said body member whereby said plate extends beyond said front face parallel to and overlapping said straight edge, wherein said front face of said body member further having a parallel recess to engage said razor blade so that when said plate is secured to said front face said recess will hold said razor blade in proper position for cutting said wallpaper wherein said recess is on said front face of said body member comprising an enlarged portion of said front face and having a plurality of notches in upper corner so that top edge of said razor blade can be adjustably positioned within one of said notches in said recess to change depth of cut of said razor blade in combination with a second wall trimmer further comprising:

(a) a hooked arm extending outwardly from one side of said body member to engage second said wallpaper trimmer so that said wallpaper trimmers are longitudinally aligned side by side; and (b) a handle extending from top of said body member so that said wallpaper trimmer can be gripped easily to slide both wallpaper trimmers along said top surface of said straight edge to double cutting length.

2. A wallpaper trimmer which comprises:

(a) an elongated straight edge having at least one longitudinal groove within the top surface;

(b) a body member having a front face, a rear face, a flat bottom face and a lug extending downwardly from said flat bottom face at said rear face, said lug engages said groove of said straight edge so that said flat bottom face of said body member can slide along said top surface of said straight edge; and (c) a razor blade carried by said front face of said body member perpendicular to said flat bottom face so that said razor blade can slide along an edge of said straight edge to cut wallpaper, further comprising means for holding said razor blade against said front face of said body member, wherein said means for holding said razor blade against said front face of said body member comprises:

(a) a pair of spaced apart threaded grommets placed within said front face of said body member;

(b) a plate having a pair of spaced apart apertures therethrough; and (c) a pair of bolts, each said bolt placed through each said aperture in said plate to threadably engage each said threaded grommet to hold said razor blade against said front face of said body member whereby said plate extends beyond said front face parallel to and overlapping said straight edge, wherein said front face of said body member further having a parallel recess to engage said razor blade so that when said plate is secured to said front face said recess will hold said razor blade in proper position for cutting said wallpaper, in combination with a second wall trimmer comprising:

(a) a hooked arm extending outwardly from one side of said body member to engage second wallpaper trimmer so that said wallpaper trimmers are longitudinally aligned side by side; and (b) a handle extending from top of said body member so that said wallpaper trimmer can be gripped easily to slide both wallpaper trimmers along said top surface of said straight edge to double cutting length.

3. A wallpaper trimmer as in claim 2, wherein the first said and second said trimmers are arranged to position said blades at a predetermined longitudinal spacing.

* * * * *